United States Patent [19]

Nagareda

[11] Patent Number: 4,941,604

[45] Date of Patent: Jul. 17, 1990

[54] FRONT PACK INFANT CARRIER

[76] Inventor: Neil N. Nagareda, 1746 Maliu St., Honolulu, Hi. 96819

[21] Appl. No.: 345,228

[22] Filed: May 1, 1989

[51] Int. Cl.[5] ..... A47D 13/02

[52] U.S. Cl. ..... 224/160; 224/253; 224/258

[58] Field of Search ..... 224/158-161, 224/202-204, 209-216, 250, 270, 257-259, 261-263, 224, 226, 264; 150/108; 383/15; 297/467, 250, 485; D3/31; D6/596, 601

[56] References Cited

U.S. PATENT DOCUMENTS

| | | | |
|---|---|---|---|
| 770,761 | 9/1904 | Lemly | 224/216 |
| 2,411,721 | 11/1946 | Hancock et al. | 224/159 |
| 2,414,698 | 1/1947 | Picard | 297/467 |
| 2,496,216 | 7/1946 | Kaminski | 224/159 |
| 2,535,683 | 12/1950 | Kimball | 224/159 |
| 2,554,340 | 5/1951 | Maxwell | 294/140 |
| 2,628,358 | 2/1953 | Neils | 224/158 X |
| 3,481,517 | 12/1969 | Aukerman | 224/160 |
| 3,871,562 | 3/1975 | Grenier | 224/160 |
| 3,934,934 | 1/1976 | Farrell, Jr. et al. | 297/467 |
| 4,234,229 | 11/1980 | Arnold | 224/160 |
| 4,271,998 | 6/1981 | Ruggiano | 224/160 |
| 4,428,514 | 1/1984 | Elf | 224/151 |
| 4,434,920 | 3/1984 | Moore | 224/160 |
| 4,458,834 | 7/1984 | Rosen | 224/160 |
| 4,469,259 | 9/1984 | Krich et al. | 224/160 |
| 4,480,775 | 11/1984 | Stanford | 224/210 |
| 4,492,326 | 1/1985 | Storm | 224/160 |
| 4,579,264 | 4/1986 | Napolitano | 224/160 |

FOREIGN PATENT DOCUMENTS

| | | | |
|---|---|---|---|
| 0120406 | 11/1945 | Australia | 224/159 |
| 0124542 | 6/1947 | Australia | 224/158 |
| 0132910 | 9/1947 | Australia | 224/158 |
| 0106127 | 10/1942 | Sweden | 224/161 |
| 0678225 | 8/1952 | United Kingdom | 224/160 |

*Primary Examiner*—Henry J. Recla
*Assistant Examiner*—Casey Jacyna
*Attorney, Agent, or Firm*—James Creighton Wray

[57] ABSTRACT

A front pack infant carrier consisting of a thick, generally rectangular foam or padded seat secured by straps made of webbing. Straps are worn over the shoulders of the wearer and the seat is positioned adjacent and substantially perpendicular to the wearer's stomach. The infant sits in a forward facing position and is held in place by the left and right shoulder straps, horizontal straps transversely crossing the front shoulder straps, and a vertical crotch strap connected to the horizontal straps and to the seat front and bottom. The crotch strap extends to form a wearer's belt-engaging loop. The shoulder straps are formed in one continuous loop, crossing at the back of the wearer.

12 Claims, 3 Drawing Sheets

FIG. 5
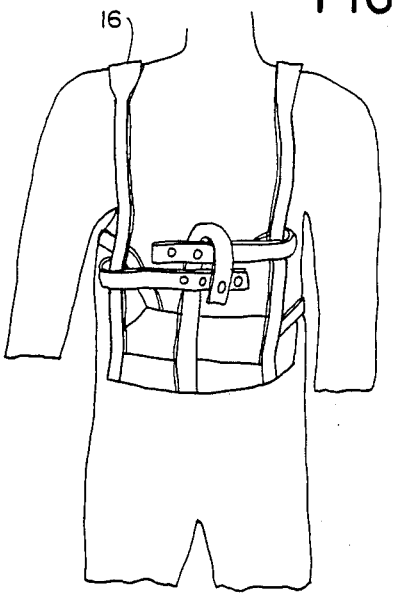
FIG. 6
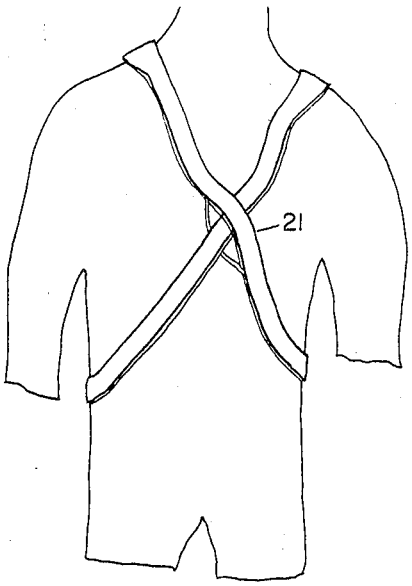
FIG. 8
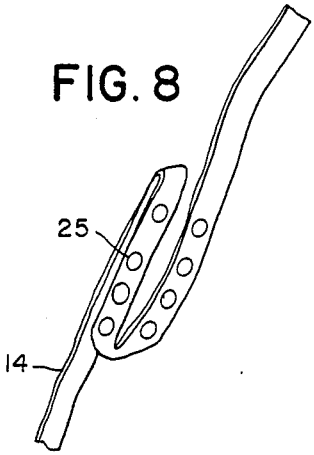
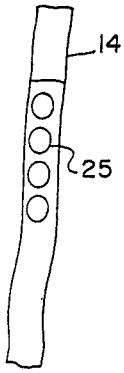
FIG. 9
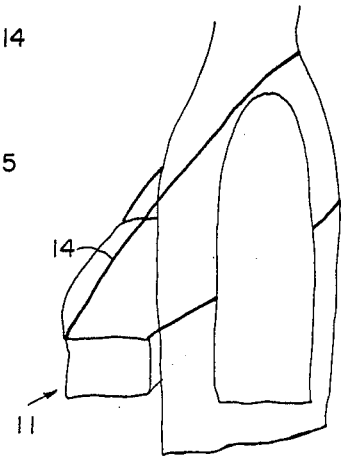
FIG. 7

FRONT PACK INFANT CARRIER

BACKGROUND OF THE INVENTION

The present invention generally relates to infant carriers, specifically those to be worn on the front of a wearer's body.

Because it is often enjoyable, and often necessary, to carry an infant or small child on excursions, carriers which hold the child within easy reach and allow for wearer-determined speed of travel are common. Carriers which hold the infant on a wearer's back are many; however, but few provide easy accessibility to the child for the wearer and must be taken off in order to allow unihibited accessibility. Therefore, carriers which position the child in the front of a wearer's body and allow for easy accessibility have become popular. These front infant carriers allow the wearer to keep the child in view at all times, and to assist or handle the child readily without removal of the pack.

Various front infant carriers are known and are generally categorized as cloth apparatuses which conform to the infant's body and have plural straps attached thereon for placement over the shoulders and around the waist of the wearer.

Many problems remain with existing front carriers. Notable among the problems are the collapsing of the carrier around the infant and the tight press of the infant's body against the wearer with attendant heating and discomfort. Existing carriers are not easily used to carry other loads.

SUMMARY OF THE INVENTION

The present invention provides an apparatus for carrying an infant or small child adjacent the wearer's stomach while allowing the wearer to continue everyday activities.

unlike the former art, the present invention consists of a semi-rigid or rigid foam or padded seat portion and a unitary strap attached to the seat portion so as to form plural shoulder straps. The seat portion of the carrier also serves the function of high chair insert, lower back stabilizer for adults, seat cushion, etc.

These and other objects of the present invention are improvements over the prior art and will be detailed in the ongoing specifications.

The front pack infant carrier principally includes a semi-rigid or rigid foam or padded seat portion which is rectangular in shape. The rectangular seat portion has top and bottom faces, a proximal side for abument with the wearer, a distal side opposite the proximal side and otherwise known as the front side, and parallel left and right ends transversely connecting distal and proximal sides. The seat is preferably worn so that the upper and lower faces of the seat portion are adjacent and substantially perpendicular to the wearer's midsection.

The seat portion is made of a rectangular fabric envelope enclosing a foam or padded insert shaped accordingly. The foam or padded insert, though not limited to, is preferably made of semi-rigid or rigid construction. This may be accomplished using reinforced foam pads, cardboard, particle board, honeycomb material or plastic with attached padding, or similar substances. Preferably the material is waterproof or is held within a waterproof bag. The insert is preferably constructed of resiliently deformable material resistant to damage incurred in use, storage, and transit. Alternately, the construction may be that of material which can be shifted within the envelope so as to conform to the child's body, or of padded hardened inserts which retain structure under stress.

In any of the above cases, however, the seat portion insert should provide sufficient padding for the infant's bottom while allowing a snug fit against the abutment with the wearer's midsection and conforming to the wearer's body structure at said abutment.

An object of the invention is to provide a carrier for a small child or infant in which the seat portion lies substantially perpendicular to the wearer's waist wherein the child sits in a position facing away from the wearer and in substantially the same direction as the wearer.

Another object of the present invention is to construct a front pack wherein the plural shoulder pads are formed from a single strap which conforms to the perimeters of the ends of the seat portion and loops from one corner to its opposite, transverse corner and similarly with adjoining corners to create a figure-8 configuration of the loose shoulder straps where the cross of the loose configuration occurs on the wearer's back It is preferable that the single strap widen at each incidence of the strap with the shoulder so as to widen the area of the strap at the points where the greatest amount of weight is supported by the wearer. Specifically, the web is preferably two and a half inches wide in other areas and three inches wide at the incidence of the shoulders.

Another object of the present invention is to sew the strap to one end of the top, side, bottom and opposite side, respectively, flush with the edge of the perimeter of that end, loosely continuing and forming a first shoulder strap to the transverse corner on the opposite end. The strap is subsequently sewn flush with the edge of the perimeter of that side, beginning down one side, along the bottom, up the side and along the top. The strap preferably doubles over the strap sewn into the first side of this end through a twisting of one portion over the other portion and subsequent sewing of the whole to the fabric envelope of the seat cushion. The object of this twisting action is to allow the strap to continue around the perimeter of the end of the seat portion and thus double over the strap already sewn on the sides and bottom. The pad continues loosely from the corner opposite and on the same side of which the first shoulder strap is attached and forms a second shoulder strap which crosses the first shoulder strap to the corner on the same side as the beginning point of the strap. The strap preferably continues down the side, along the bottom and up the opposite side to double over and reinforce the other side of the seat portion.

Another object of the present invention is to provide an adjustable means for adjusting the weight of the shoulder strap so as to allow the wearer to situate the seat portion and straps in a suitable manner for carrying of the infant. It is perferable that the adjustable means consist of snaps running lengthwise along the front portions of each shoulder strap which can be mated upon the doubling over of each shoulder strap to lengthen or shorten each strap. Alternately, each strap could be provide with a buckle typical to such packs, buttons simiarly aligned to the snaps, or similar adjustable means.

An object of the present invention is to provide a security and stability means to hold the infant securely in the front pack infant carrier.

A preferred embodiment incorporates two substantially equal straps which each connect to a respective front portion of a shoulder strap and extend horizontally towards each other across the plane created by the plural shoulder straps. These horizontal straps preferably connect in the middle to provide a waist security seat belt for the infant. Preferably, these straps are adjustably connected to their respective shoulder straps through looping around the straps and being either sewn or snapped back onto thenselves. The attachment means of one strap to the other is preferably heavy duty snaps, but alternately could be a buckling mechanism, buttons or similar attachment devices.

Similarly, a preferred constraint device attaches vertically to the front of the seat cushion and upward to adjustably attach to the horizontal security strap, effectively creating a crotch strap for the infant for prevention of sliding out of the seat under the horizontal strap. This strap loops over the connected horizontal straps and snaps, buttons or buckles back onto itself in an adjustable means. The vertical crotch strap preferably extends and is sewn onto the bottom of the seat portion, substantially bisecting said bottom crosswise. Preferably this crotch strap extends outward from the side opposite the vertical extension of the crotch strap, that is extends outward from the side proximal the abutment with the wearer, and is constructed so as to allow the wearer to loop the extension around a belt worn at the waist and attach back onto itself.

An object of this extension is to prevent the abutment of the seat and the wearer from becoming a large gap into which the child may fall. It is a further object to stabilize the carrier laterally and ease the weight strain upon the shoulders.

An object of the invention is to allow the straps to cross across the back of the wearer so as to add stability and evenly distribute the weight of the infant and carrier on the wearer. The straps are preferably adjustably crossed by sewing the ends of a portion of separate strapping to a portion of the shoulder straps which will fall proximal to the middle of the back. The second strap preferably is threaded through the aperture.

Another object of the invention is to provide reinforcement along the bottom of the seat portion of the infant carrier. The bisection of the crotch straps forms crosswise support for the seat. Preferably, plural straps run lengthwise along the seat portion in order to provide support in that direction.

While the immediate uses of the present invention are obvious, subsequent uses reveal its novelty. An object of the present invention is to provide alternate uses for the front pack infant carrier.

Another object of the invention is to provide a children's booster seat for restaurants, etc. The horizontal waist strap and vertical crotch strap serve as restraining devices for the child. The height of the seat portion helps to raise the child to seat portion and can be used either in conjunction with the straps or alone for this purpose.

Alternately, another object of the invention is to provide adults with a spare cushion for activities. The padded seat portion can act as a stadium seat or similar padded device to sit on. Alternately, the seat portion could be used as a brace commonly used for lower back pains. In another embodiment, the seat portion could be covered with a waterproof envelope so as to provide a floatation device for water sports.

In another embodiment, the fabric envelope for the seat cushion and attached straps are removable through the incorporation of a longitudinal slit in one side and closure for that slit; therefore, allowing the elements exposed to the child, wear, etc., to be readily washable. This would also allow for the changing of padding elements.

These and further and other objects and features of the invention are apparent in the disclosure, which includes the drawings and the above and ongoing specification with the claims.

BRIEF DESCRIPTION OF THE DRAWINGS

FIG. 5 is a frontal view of the carrier as worn.

FIG. 6 shows a rear view of the carrier as worn.

FIG. 7 shows a side view of the carrier as worn. strap.

FIGS. 8 and 9 show length adjustment of the front straps for adjusting seat height.

DETAILED DESCRIPTION OF THE INVENTION

Figure 1:
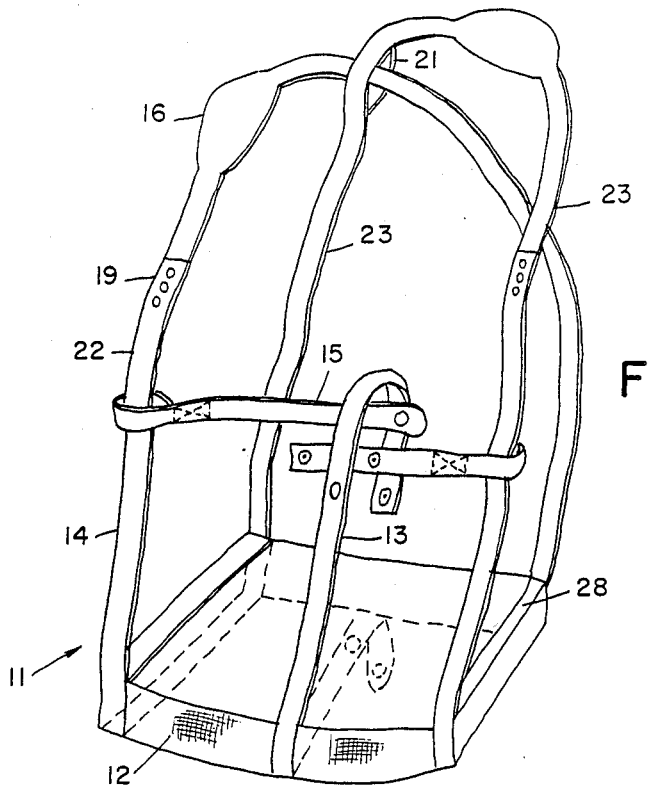
FIG. 1 is a perspective view of the front of the infant carrier constructed according to the present invention.
Figure 2:
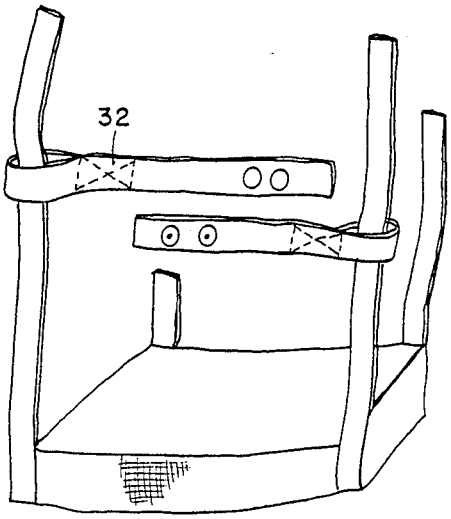
FIGS. 2 and 3 show alternate embodiments of the horizontal front straps.
Figure 3:
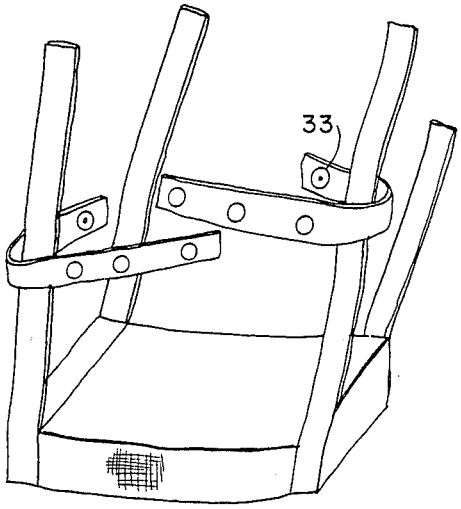

Referring now to FIGS. 1–10, the infant carrier is generally referred to by the numeral 11. The apparatus has a seat portion 12, shoulder straps 14, horizontal waist support strap 15 and vertical strap 13. THe shoulder straps 14 cross each other at the wearer's back and hold the rectangular seat portion 12 substantially perpendicular to the wearer's waist. The infant sits on the seat portion 12 facing away from the wearer. Vertical crotch strap 13, transverse horizontal strap 15, and right and left shoulder straps 22 and 23 provide support for the infant's crotch, trunk and right and left sides or torso, respectively.

FIG. 1 is a frontal view of the invention. The carrier 11 generally consists of embodiments which perform three main functions: supporting the infant's bottom adjacent the wearer's stomach, securing the infant into the carrier, and attaching the carrier to the wearer's body.

The infant is generally supported by the rectangular seat portion 12 which is disposed substantially perpendicular to the wearer's waist so that the infant is held in a position facing away from the wearer.

As shown in FIG. 1, left and right front shoulder straps 23 and 22 extend upward from the front of the seat portion 12 to the widened shoulder strap portions 16 and thus support the infant on left and right sides of the torso. Crotch strap 13 provides frontal support for the infant between the legs and prevents the infant from sliding out of the carrier. Horizontal straps 15 snap across the waist and chest of the infant and hold the infant in the carrier. Adjustable means 19 on shoulder straps 14 allow for adjusting the height of the shoulder straps and position of the carrier 11 on the wearer's body.

FIGS. 8 and 9 show the adjustable means 19 of the shoulder strap where opposable snaps 25 are placed lengthwise along the straps and thus allow an easy means for doubling the strap and fastening it onto itself, thus shortening or lengthening the strap. Opposable snaps 25 can also be used on vertical crotch strap 13 and horizontal strap 15, as shown in FIGS. 1 and 4.

Webbed strapping 28 is attached to the seat portion 12, which comprises fabric envelope 29 and semi-rigid foam or padded insert 30.

Figure 4:
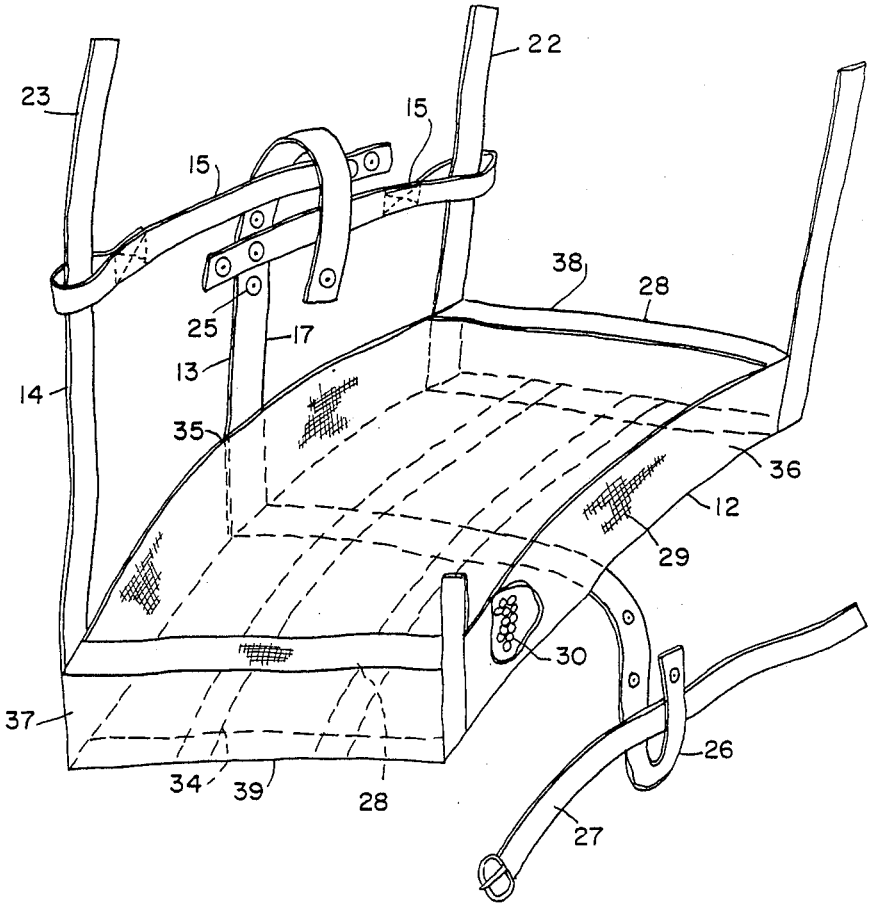
FIG. 4 is a prespective side view of the infant carrier showing means for attaching the carrier to a belt of a wearer.

FIG. 4 is a rear left elevational view of the seat portion and attached support and security strapping. The crotch strap is sewn to the front, distal side 35 and bottom face 39 of the seat portion, substantially bisecting the seat crosswise thereof. The crotch strap 13 has two ends which extend freely from the seat portion. The belt loop security fastener 26 extends perpendicular from the bottom of the proximal side 36 of the seat portion and attaches to the wearer's belt 27 to hold the seat portion adjacent the wearer's waist. The vertical portion 17 of the crotch strap 13 extends vertically upward from the distal front side 35 of the seat portion substantially parallel to right and left front shoulder straps 22 and 23, loops over and attaches to horizontal straps 15 and connects back onto itself with snaps 25. Plural reinforcement straps 34 are sewn lengthwise from left end 37 to right end 38 of the seat portion to provide horizontal reinforcement of the seat portion.

The infant carrier 11 is worn on the front of the wearer's body adjacent and substantially perpendicular to the wearer's waist and is held in said position by shoulder straps which run from each waist to opposite shoulders, crossing at an adjustable loop portion 21 on the wearer's back, as shown in FIGS. 5, 6 and 7. FIGS. 7 and 8 show variations with which the horizontal straps may be attached to the shoulder straps. The straps are looped around each respective shoulder strap and are snapped 33 or sewn 32.

FIG. 1 shows the attachment of the single web or strap 14 to the seat portion 12 in such a configuration as to provide plural shoulder straps and end supports for the carrier. The strap is sewn beginning, for example, at a top corner of the seat and around the whole perimeter of the adjacent end back to the beginning corner, across the top of the seat portion to the oppsite, transverse corner, around the perimeter of the opposite end, back to the corner, looping over itself, so as to allow strapping to double itself along the bottom and side portions of the ends, doubling down the side, across the bottom and up the opposite side to the adjacent top corner, loosely crossing the top of the seat portion to the opposite transverse top corner, and around the adjacent end to a finishing point proximal to the beginning point.

To accomplish the procedure of constructing the seat using a single web strap for the shoulder straps and end-surrounding attachments, it may be useful to twist one portion of the strap over another so as to previde a continous loop.

Other methods may be alternately used to accomplish the attachment of the strap to the ends of the seat portion. For example, separate strap portions may be bonded or sewn to the seat cover. The fabric cover may be bonded to the foam or may be sewn as a slip--on case. The foam seat may be self surfaced or may be coated and the straps may be bonded to the foam self skin or may be bonded under or on top of the coating.

Many modifications and variations of the present invention can be made with regard to the foregoing specification and detailed description of the present invention without departing from the scope of the invention.

I claim:

1. A front pack infant carrier comprising a thick foam or padded seat portion and straps attached to the seat portion wherein the staps are worn over the shoulders of the wearer and the seat portion is arranged adjacent the wearer's stomach whereby the infant sits in a forward position facing away from the wearer's stomach; said foam or padded seat portion comprising a semi-rigid construction providing padding for the infant's bottom and wearer's stomach, the whole seat construction being enclosed in an envelope of a suitable cover, the seat portion further comprising a substantially flattened, generally rectangular shape where the largest areas are the top and bottom faces, a side proximal to the abutment of the seat with the wearer, a distal side opposite the abutment, and left and right ends substantially equal in area and length; shoulder strapping comprising a single web strap wherein the strap is fixed on the seat portion so as to situate the flattened rectangular seat portion adjacent and substantially perpendicular to the wearer's stomach; said single strap forming a continuous loop wherein the strap is fixed on the fabric envelope around the perimeters of the left and right ends of the seat, forming attachments between the strap and the seat at each of the seat portion's four corners, wherein portions of the straps not attached to the perimeter of each end of the seat form two shoulder straps forming a crossing configuration across the wearer's back, said crossing configuration formed by crossing a loose strap portion protruding from a first distal top corner of the seat portion and attaching this loose portion to a second proximal top corner oppositely transverse the first top corner, leaving sufficient loose strapping or webbing for passing upward over the wearer's shoulder and downward and across a wearer's back and around a wearer's side, attaching the strapping from the second top corner around the perimeter of an adjacent end of the seat portion wherein the strap protrudes from a third distal top corner adjacent and on the same seat portion end as the second top corner portion, a free portion of the strap passing upward over a wearer's shoulder and downward across a wearer's back and around a side and being connected to a fourth proximal top corner adjacent and on the same seat portion end as the first top corner, and the stapping being attached around the perimeter of that end a horizontal strap attached transversely to the front staps, said strap comprising two substantially equal first and second smaller straps, each smaller strap attached to one front strap, respectively, each smaller strap further having adjustable attachment means for connection of first smaller strap to second smaller strap to form said single horizontal strap; a vertical strap adjustably attachable to the horizontal strap at substantially a middle of horizontal strap, said vertical security strap attaching vertically to a middle portion of a front side of seat and being attached across a bottom face of the seat, thus providing reinforcement for the seat bottom, said vertical security strap further extending from the seat bottom face at an intersection of the bottom face and a proximal side of the seat leaving a portion of said security strap unattached, said unattached portion being adjustably attachable to a wearer's belt; the horizontal strap transversely crossing front shoulder straps and the vertical security strap secured respectively to central distal seat portion and horizontal strap creating waist and crotch security straps for an infant.

2. The infant carrier of claim 1 wherein the attachment of the strap on the seat beginning at a top corner of either the left or right side, the strap forming a continuous loop by fastening flush to a proximal side portion, to a length of the bottom of the seat upward along a side edge of the distal side, running transversely across the top of the seat to the opposite side edge and again partially around the seat, while leaving a substantial portion of the strap free to form a first shoulder strap, then attaching and running down the front side edge of the distal portion, along the adjacent bottom side portion and up the front side edge portion of the distal portion of the seat cover, running transverse across the top of the seat portion to reconnect with the first point of attachment at the left front side edge portion of the proximal portion of the seat portion and then partially around the seat sides and bottom, while leaving substantially free strapping for a second shoulder strap portion.

3. The infant carrier of claim 1 wherein the shoulder straps are further constructed to rest over the shoulders of a wearer wherein loops cross proximal to the abutment of the wearer and the seat portion, said shoulder straps constructed so the web is wider at incidence of the straps with the shoulders;

said straps further having adjustable means for shortening or lengthening each strap.

4. The infant carrier of claim 1 wherein crossover of the shoulder straps on the wearer's back comprises an adjustable means wherein a length of strap has its ends sewn to a portion of one strap proximal to the crossing point wherein the other strap is threaded through the aperture between the shoulder strap and the length of the strap sewn to it, therefore allowing the user to gain control over where the straps cross on the back.

5. The infant carrier of claim 1 wherein the strap is comprised of two and a half inch wide webbing which widens to three inches at the incidence of the shoulder straps with the shoulders.

6. The infant carrier of claim 1 wherein the shoulder straps are continuous and further comprising adjustable means on the continuous shoulder straps for the shortening or lengthening of the continuous shoulder straps comprise matched snaps running lengthwise on the front portion of each shoulder strap so as to provide a method for doubling the strap and fastening mated snaps and thereby shortening the continuous straps, and wherein both of said straps are both continuous and adjustable.

7. The infant carrier of claim 1 wherein the horizontal security strap further comprises a means of adjustably attaching the two smaller straps so as to tighten or loosen the straps around the waist of the infant wherein the attachment means is a plurality of snaps situated lengthwise at the conjunctive end of each smaller strap, one strap having mated for the other strap.

8. The horizontal straps of claim 1 wherein the ends of the smaller straps attached to the shoulder straps comprise an attachment means which loops around the shoulder strap and is attached onto itself and thus positions the strap substantially perpendicular to its respective shoulder strap.

9. A front pack child carrier comprising a thick cushioned seat having a covering extending around the seat and having an upper face, a bottom face, a front face, a rear face, and left and right side faces, first and second shoulder straps extending upward in loops between diametrically opposite corners, the first strap extending from a corner at the intersection of the front face and right side face to a corner at the intersection of the rear face and left side face, and the second shoulder strap extending from an intersection of the front face and left side face to an intersection of the rear face and right side face, a horizontal waist strap having looped ends for surrounding front portions of the shoulder strap above a front face of the seat and a vertical strap having a loop around the horizontal strap between the front portions of the shoulder strap and extending downward therefrom over the front face and beneath the bottom of the seat, and a strap extending from the rear of the seat for being held to the waist of the wearer wherein the strap which extends from then rear of the seat is an extension of the vertical strapk which extends from the horizontal strap downward around the seat bottom face and terminates in a loop which is attachable to a device extending around a wearer's waist.

10. The child carrier of claim 9 wherein the horizontal strap is made in two portions, each of which is looped around a front portion of the shoulder strap, the two portions having connection means for medially connecting in front of the child and for releasing to remove a child from the seat.

11. The child carrier of claim 9 wherein the shoulder straps are made in one continuous loop, lower portions of the straps being wrapped around edge portions of the seat.

12. THe child carrier of claim 11 wherein the front shoulder straps are doubled and secured together with plural vertically aligned selectively connectable fasteners whereby the lenghts of the straps are adjustable.

* * * * *